United States Patent [19]

Ikeda et al.

[11] Patent Number: 5,000,802

[45] Date of Patent: Mar. 19, 1991

[54] WATER-IN-OIL TYPE EMULSION EXPLOSIVE

[75] Inventors: Yoshiyuki Ikeda, Ube; Atsuo Inoue, Yamaguchi; Yoshio Tanabe, Ube, all of Japan

[73] Assignee: Nippon Kayaku Kabushiki Kaisha, Tokyo, Japan

[21] Appl. No.: 565,330

[22] Filed: Aug. 9, 1990

[51] Int. Cl.[5] ..... C06B 45/00

[52] U.S. Cl. ..... 149/2; 149/21; 149/46; 149/47; 149/61; 149/92

[58] Field of Search ..... 149/2, 21, 46, 47, 61, 149/92

[56] References Cited

U.S. PATENT DOCUMENTS 4,357,184 11/1982 Binet et al. ..... 149/2
4,548,660 10/1985 Ikeda et al. ..... 149/21
4,931,110 6/1990 McKenzie et al. ..... 149/2

OTHER PUBLICATIONS

Encyclopedia of Polymer Science and Technology, vol. 8, pp. 97–120.

*Primary Examiner*—Stephen J. Lechert, Jr.
*Attorney, Agent, or Firm*—Henry C. Nields

[57] ABSTRACT

This invention relates to a water-in-oil type emulsion explosive comprising an aqueous oxidizer solution, an oily material, an emulsifier and hollow microspheres, in which the whole or a part of the oily material is replaced with a polymer which is oil-soluble and has a ladder structure in the molecule.

8 Claims, No Drawings

WATER-IN-OIL TYPE EMULSION EXPLOSIVE

BACKGROUND OF THE INVENTION

The present invention relates to a water-in-oil (W/O) type emulsion explosive which can be used for the industrial blasting for various purposes such as, for example, excavation of tunnels, quarrying and mining.

Many improvements and inventions have been made regarding the W/O type emulsion explosives ever since this type of explosive was disclosed for the first time in U.S. Pat. No. 3,161,551. The W/O type emulsion explosives in these inventions are basically of the composition comprising a mineral oil, wax or other hydrophobic carbonaceous fuel (oil) as continuous phase, an aqueous solution of oxidizers mainly composed of ammonium nitrate as discontinuous phase, and a W/O type emulsifier. By properly adding a sensitizer such as hollow microspheres to the composition, there can be obtained the W/O type emulsion explosive of various level of initiating sensitivity ranging from booster initiation to cap initiation. As is well known, these W/O type emulsion explosives, because of use of oily material as continuous phase, are excellent in water resistance and safety in comparison with the conventional explosives.

The W/O type emulsion explosives have the problem that they lack stability since the emulsion is formed by mixing two mutually, insoluble liquids into a homogeneous liquid mixture comprising fine droplets of one liquid in the other liquid with the aid of an emulsifier. Many inventions purposed to improve stability of this type of emulsion explosives have been made. A method for improving stability is to use a specific emulsifier as for instance proposed in Japanese Patent Application Laid-Open (Kokai) Nos. 58-120588 (1983) and 58-190890 (1983) and U.S. Pat. Nos. 4,482,403 and 4,698,105. Use of a specific oil is another method for improving stability of said emulsion explosives, as for instance proposed in Japanese Patent Application Laid-Open (Kokai) Nos. 57-149893 (1982), 61-40892 (1986) and 61-40893 (1986) and U.S. Pat. Nos. 4,386,977, 4,548,660 and 4,470,855.

Stability of the W/O type emulsion explosives was greatly improved by these inventions, and this type of explosives has come to be used widely. However, the W/O type emulsion explosives still have the problem that the sensitivity lowers with the lapse of time, and some of those W/O type emulsion explosives which have been kept in storage for 2 to 3 years fail to detonate in the hole due to insufficient sensitivity.

SUMMARY OF THE INVENTION

The present invention provides a water-in-oil type emulsion explosive comprising an aqueous oxidizer solution, an oily material, an emulsifier and hollow microspheres, in which the whole or a part of the oily material is replaced with a polymer which is oil-soluble and has a ladder structure in the molecule.

DETAILED DESCRIPTION OF THE INVENTION

As a result of elaborate studies on change of stability with time of W/O type emulsion explosives, the present inventors have found that at the summer season, namely at the times when the temperature is high, there takes place lowering of sensitivity of the explosives, but at the spring, fall and winter seasons, namely at the times when the temperature is not so high, there occurs no reduction of sensitivity of said explosives. This fact directed the present inventors to the effort for obtaining a W/O type emulsion explosive which is stable at high temperatures such as experienced in the summer season.

Under this concept, the present inventors have carried out many researches and experiments and, as a result, found that when the whole or a part of the oily material forming the continuous phase of W/O type emulsion explosive is replaced with a polymer which is oil-soluble and has a ladder structure in the molecule, there can be obtained a W/O type emulsion explosive which is stable for a long time even under high temperatures.

The polymer used in the present invention is the one which is oil-soluble and has, in its molecule, a ladder structure such as described in Encyclopaedia of Polymer Science and Technology, Vol. 8, published by Inter-Science Publisher Co., Ltd. It is notable that an especially good result can be obtained when using said type of polymers having a softening point of 0° to 150° C. and a number average molecular weight of 50 to 2,000.

Said type polymer is prepared by using, as starting material, cyclopentadiene, dicyclopentadiene or methylcyclopentadiene etc.

An even better result can be obtained when using said type of polymer, prepared by using, as starting material, especially, a dicyclopentadiene having, for example, a chemical structure of

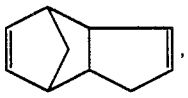

namely a polymer or copolymer of dicyclopentadiene.

Examples of said type of polymer (being oil-soluble and having a ladder structure in the molecule) usable in the present invention are Escorez 5380 (a hydrogenated alicyclic hydrocarbon resin having a softening point of 85° C. and a specific gravity (25/4 deg.C.) of 1.10, sold by Tonex Co., Ltd.), Escorez 5300 (a hydrogenated alicyclic hydrocarbon resin having a softening point of 105° C., a specific gravity (25/4 deg.C.) of 1.10 and a number average molecular weight of about 290) and Escorez 5320 (a hydrogenated alicyclic hydrocarbon resin having a softening point of 125° C., a specific gravity (25/4 deg.C.) of 1.10 and a number average molecular weight of about 340) having the following ladder structure as a basic structure:

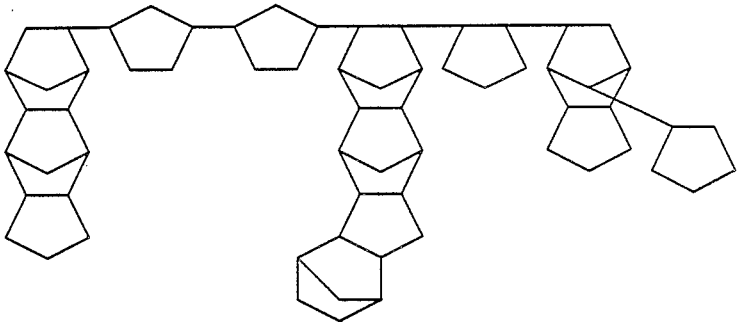

Escorez 8180 (an alicyclic hydrocarbon resin having a softening point of 86° C., a specific gravity (25/4 deg.C.) of 1.10 and a number average molecular weight of about 200) having the following ladder structure as a basic structure:

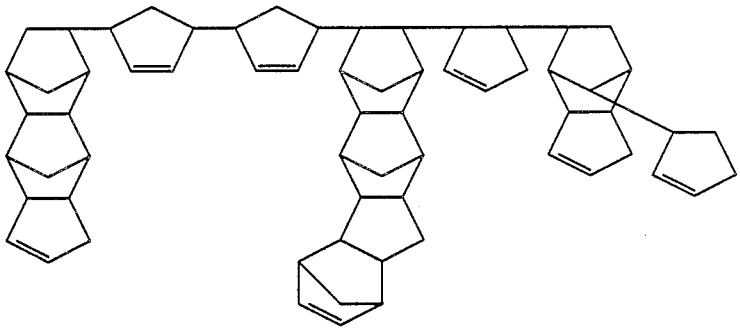

Escorez 1401 (aliphatic/alicyclic hydrocarbon resin having a softening point of 119° C., a specific gravity (25/4 deg.C.) of 0.97 and a number average molecular weight of about 1,000), ECR 327 (an alicyclic hydrocarbon resin having a softening point of 15° C., a specific gravity (25/4 deg.C.) of 1.10 and a number average molecular weight of about 80) and ECR 356B (an alicyclic hydrocarbon resin having a softening point of 140° C., a specific gravity (25/4 deg.C.) of 1.10 and a number average molecular weight of about 390) having a basic ladder structure similar to those shown above.

Said type of polymer used in the present invention can replace the whole or a part of the oily material in the W/O type emulsion explosive composition. Said polymer can be used in admixture with an oil component such as mineral oil, vegetable oil, animal oil, fuel oil, kerosine, liquid paraffin, paraffin wax, microcrystalline wax, petrolatum and the like. Said polymers can be also used in combination with others types of resin such as petroleum resin, epoxy resin, unsaturated polyester resin, polybutene, polyisobutylene, butadiene resin, α-olefin polymer and the like.

For maintaining sensitivity of W/O type emulsion explosives stably at high temperatures, preferably 1% by weight or more, more preferably 5 to 70% by weight of the oily material constituting the continuous phase in the explosive is replaced with the polymer being oil-soluble and having a ladder structure in the molecule.

In the explosives according to the present invention, the oily material is used in an amount preferably in the range of 1 to 10% by weight based on the total weight of the W/O type emulsion explosive. It is more preferable to constitute the continuous phase by using the oily material in an amount in the range of 2 to 8% by weight.

An aqueous oxidizer solution used in the present invention can be prepared by dissolving one or a mixture of two or more of the following substances in water: ammonium nitrate, alkali metal nitrates, alkaline earth metal nitrates, alkali metal chlorates, alkaline earth metal chlorates, alkali metal perchlorates, alkaline earth metal perchlorates and ammonium perchlorate.

In the aqueous oxidizer solution used in the present invention, there may be added a water-soluble amine nitrate such as monomethylamine nitrate, monoethylamine nitrate, hydrazine nitrate and dimethylamine dinitrate, a water-soluble alkanolamine nitrate such as methanolamine nitrate and ethanolamine nitrate, water-soluble ethylene glycol mononitrate or the like as an auxiliary sensitizer.

The water content in the aqueous oxidizer solution is preferably so selected that the crystallization temperature of said aqueous solution will become 30 to 90° C. Usually it is preferable that the water content is in the range of 5 to 40% by weight, more preferably 7 to 30% by weight, based on said aqueous oxidizer solution.

In the aqueous oxidizer solution, it is possible to add a water-soluble organic solvent such as methyl alcohol, ethyl alcohol, formamide, ethylene glycol, glycerin and the like as an auxiliary solvent for lowering the crystallization temperature of the solution.

In the present invention, the aqueous oxidizer solution is used in an amount within the range of 50 to 95% by weight based on the total amount of W/O type emulsion explosive.

The emulsifier used in the present invention is of the type which is usually used for forming W/O type emulsions. Examples of such emulsifier are alkali metal stearates, ammonium stearate, calcium stearate, polyoxyethylene ethers, sorbitan esters of a fatty acid, sorbitol esters of a fatty acid and the like. These compounds may be used either singly or in a suitable mixture.

The amount of the emulsifier used in the present invention is preferably in the range of 0.5 to 7% by weight based on the total weight of the W/O type emulsion explosive.

In accordance with the present invention, there can be obtained the W/O type emulsion explosives showing an initiating sensitivity of a broad range from cap initiation to booster initiation, by adding appropriate hollow microspheres in the W/O type emulsion explosive. As the hollow microspheres, there can be used hollow glass microspheres, resin-made hollow microspheres, silastic baloon, perlite and the like either singly or in combination.

The amount of the hollow microspheres used in the present invention is so selected that the specific gravity of the final product of the W/O type emulsion explosive will become not higher than 1.40 g/cc, preferably not higher than 1.30 g/cc. The amount of the hollow microspheres used is variable according to the specific gravity of the microspheres and other factors, but usually used in an amount in the range of 0.5 to 20% by weight based on the total weight of the W/O type emulsion explosive.

In the W/O type emulsion explosives according to the present invention, an explosive substance such as TNT, penthrit and the like may be contained together with the hollow microspheres. It is also possible to make the bubbles contained in the W/O type emulsion explosive by mechanical or chemical means to substitute a part of the role of the hollow microspheres.

It is further possible to add a metal powder such as aluminum and magnesium powder, or an organic powder such as wood powder and starch in the W/O type emulsion explosive according to this invention.

The W/O type emulsion explosive according to the present invention is produced, for example, in the following manner.

Ammonium nitrate or a mixture thereof with one or more other oxidizer salts is dissolved in water at about 85° to 95° C. to prepare an aqueous oxidizer solution. Meantime, an oil-soluble polymer having a ladder structure in the molecule or a mixture of such a polymer and an oil substance or resin are sufficiently and uniformly dissolved at about 85° to 95° C., and an emulsifier is mixed therein to form an oil-phase mixture. To this oil-phase mixture is gradually added the previously prepared aqueous oxidizer solution while stirring the mixture at a speed of 200 to 500 r.p.m. by using a spiral blade agitator which is usually used for stirring highly viscous materials. After the completion of the addition, stirring is further continued at the same speed for one minute, followed by additional two-minute stirring at a raised speed of 800 to 1,300 r.p.m. The resulting emulsion is added with the hollow microspheres and if necessary other additive(s) and mixed by a vertical kneader at a mixing speed of about 30 to 60 r.p.m. for 5 minutes to obtain a W/O type emulsion explosive of the present invention.

In the present invention, the whole or a part of the oily component constituting the continuous phase of a W/O type emulsion explosive is replaced with a polymer which is oil-soluble and has a ladder structure in the molecular as described above, thereby giving a W/O type emulsion explosive which is remarkably minimized in lowering of sensitivity at high temperatures, that is, very excellent in storage stability in comparison with the conventional W/O type emulsion explosives.

The present invention will be described in further detail below by showing the examples thereof.

EXAMPLE 1

1.5% by weight of an oil-soluble aliphatic/ alicyclic hydrocarbon resin having a ladder structure in the molecule [Escorez, 1401 (trade name) sold by Tonex Co., Ltd.], which has been obtained by copolymerizing dicyclopentadiene and $C_5$ petroleum fraction and has a number average molecular weight of about 1,000 and a softening point of 119° C., and 1.0% by weight of liquid paraffin (reagent) were well mixed under heating at about 90° C. To this mixture were added 4.5% by weight of sorbitol dioleate as emulsifier and an aqueous oxidizer solution prepared by dissolving 62.8% by weight of ammonium nitrate and 10.0% by weight of sodium nitrate in 14% by weight of water by heating at about 90° C., followed by sufficient mixing by stirring to form a W/O type emulsion. To this emulsion were added and mixed 6.2% by weight of glass bubbles [B28/750 (trade name) produced by 3M Co., Ltd.], to obtain a W/O type emulsion explosive. The obtained W/O type emulsion explosive was packed in the 25 mm-diameter paper tubes (100 g of explosive in each paper tube) to form the cartridges.

COMPARATIVE EXAMPLE 1

In the same way and with the same composition as Example 1 except for use of 1.5% by weight of a microcrystalline wax (Eslux 172 produced by Esso Standard Oil) in place of the polymer used in Example 1, there were produced a W/O type emulsion explosive and cartridges thereof.

EXAMPLE 2

0.3% by weight of an oil-soluble alicyclic hydrocarbon resin having a ladder structure in the molecule (Escorez 8180 sold by Tonex Co., Ltd.), which has been produced by polymerizing dicyclopentadiene and has a number average molecular weight of about 200 and a softening point of about 86° C., and 3.2% by weight of a microcrystalline wax (Eslux 172) were mixed well under heating at about 90° C. To this mixture were added 2.0% by weight of sorbitan monooleate as emulsifier and an aqueous oxidizer solution previously prepared by dissolving 56.5% by weight of ammonium nitrate, 15.0% by weight of sodium nitrate and 10.0% by weight of hydrazine nitrate in 8% by weight of water by heating at about 100° C., followed by sufficient mixing with stirring to form a W/O type emulsion. To this emulsion were added and mixed 2.0% by weight of glass bubbles [B28/750 (trade name) produced by 3M Co., Ltd.] and 3.0% by weight of perlite to obtain a W/O type emulsion explosive. The obtained explosive was packed in the 25 mm-diameter paper tubes (100 g of explosive in each paper tube) to form the cartridges.

COMPARATIVE EXAMPLE 2

A W/O type emulsion explosive and cartridges thereof were produced by following the same procedure as Example 2 except that an alicyclic hydrocarbon resin having the basic structure of

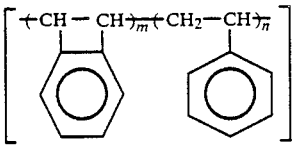

with no ladder structure in the molecule [Arkon P-70 (trade name) produced by Arakawa Chemical Industries Co., Ltd.] was used in an amount of 0.3% by weight in place of the polymer used in Example 2.

EXAMPLE 3

3.2% by weight of an oil-soluble hydrogenated alicyclic hydrocarbon resin having a ladder structure in the molecule [Escorez, 530 (trade name) sold by Tonex Co., Ltd.], which has been obtained by polymerizing and hydrogenating dicyclopentadiene and has a number average molecular weight of about 290 and a softening point of about 105° C., was melted under heating at about 115° C. To this molten resin were added 2.7% by weight of sorbitol dioleate as emulsifier and an aqueous oxidizer solution previously prepared by dissolving 71.4% by weight of ammonium nitrate and 7.5% by weight of sodium nitrate in 11% by weight of water by heating at about 90° C., followed by sufficient mixing with stirring to form a W/O type emulsion. To this emulsion were added 4.2% by weight of glass bubbles [B28/750 (trade name) produced by 3M Co., Ltd.] to obtain a W/O type emulsion explosive. The obtained explosive was packed in the 25 mm-diameter paper tubes (100 g of explosive in each paper tube) to form the cartridges.

COMPARATIVE EXAMPLE 3

A W/O type emulsion explosive and cartridges thereof were produced by following the same procedure as Example 3 except that 3.2% by weight of a petroleum resin [Hi-rez C-110X (trade name) produced by Mitsui Petrochemical Co., Ltd.] obtained by polymerizing a $C_5$ petroleum fraction was used in place of the polymer used in Example 3.

EXAMPLE 4

1.0% by weight of an oil-soluble alicyclic hydrocarbon resin having a ladder structure in the molecule [Escorez ECR 327 (trade name) sold by Tonex Co., Ltd.], produced by polymerizing dicyclopentadiene and having a number average molecular weight of about 80 and a softening point of about 15° C., 1.0% by weight of a paraffin wax having a melting point of 146° F. [145° Paraffin (trade name) produced by Nippon Sekiyu KK] and 1.0% by weight of a petroleum resin (C-110X) were mixed well under heating at about 90° C. To this mixture were added 0.7% by weight of sorbitan monooleate and 0.5% by weight of sorbitol dioleate as emulsifier and an aqueous oxidizer solution previously prepared by dissolving 71.1% by weight of ammonium nitrate and 7.5% by weight of sodium nitrate in 12% by weight of water by heating at about 90° C., followed by sufficient mixing with stirring to form a W/O type emulsion. To this emulsion were mixed 5.2% by weight of glass bubbles (B28/750) to obtain a W/O type emulsion explosive. The obtained explosive was packed in the 25 mm-diameter paper tubes (100 g of explosive in each paper tube) to form the cartridges.

COMPARATIVE EXAMPLE 4

A W/O type emulsion explosive and cartridges thereof were produced by following the same procedure as Example 4 except that 1.0% by weight of Arkon P-70 used in Comparative Example 2 was employed in place of the polymer used in Example 4.

EXAMPLE 5

0.9% by weight of an oil-soluble alicyclic hydrocarbon resin having a ladder structure in the molecule [Escorez 530 (trade name) sold by Tonex Co., Ltd.] which has been prepared by polymerizing dicyclopentadiene and has a number average molecular weight of about 290 and a softening point of about 105° C., and 2.1% by weight of a microcrystalline wax (Eslux 172) were mixed well under heating at about 90° C. To this mixture were added 3.1% by weight of sorbitol dioleate as emulsifier and an aqueous oxidizer solution previously prepared by dissolving 73.4% by weight of ammonium nitrate and 6.0% by weight of sodium nitrate in 10% by weight of water by heating at about 100° C., followed by sufficient mixing with stirring to form a W/O type emulsion. Then 4.5% by weight of glass bubbles (B28/750) were added to and mixed in the emulsion to obtain a W/O type emulsion explosive. The obtained explosive was packed in the 25 mm-diameter paper tubes (100 g of explosive in each paper tube) to form the cartridges.

COMPARATIVE EXAMPLE 5

A W/O type emulsion explosive and cartridges thereof were produced by following the same procedure as Example 5 except that Arkon P-70 used in Comparative Example 2 was used in an amount of 0.9% by weight in place of the polymer used in Example 5.

The compositions of the W/O type emulsion explosives obtained in Examples 1-5 and Comparative Examples 1-5 are shown collectively in Table 1.

TEST EXAMPLE

The emulsion explosive cartridges of Examples 1-5 and Comparative Examples 1-5 were kept in a high-temperature (45° C.) thermostat. The cartridges were taken out of the thermostat every one month and subjected to an initiation test by using No. 6 and No. 8 caps. The test results are shown in Table 2.

TABLE 1

| | Example | | | | | Comparative Example | | | | |
|---|---|---|---|---|---|---|---|---|---|---|
| | 1 | 2 | 3 | 4 | 5 | 1 | 2 | 3 | 4 | 5 |
| Escorez 1401 | 1.5 | | | | | | | | | |
| Escorez 8180 | | 0.3 | | | | | | | | |
| Escorez ECR327 | | | | 1.0 | | | | | | |
| Escorez 5300 | | | 3.2 | | 0.9 | | | | | |
| Liquid paraffin | 1.0 | | | | | 1.0 | | | | |
| 145° Paraffin | | | | 1.0 | | | | | 1.0 | |
| Eslux 172 | | 3.2 | | | 2.1 | 1.5 | 3.2 | | | 2.1 |
| C-110X | | | | 1.0 | | | | 3.2 | 1.0 | |
| Arkon/P-70 | | | | | | | 0.3 | | 1.0 | 0.9 |
| Water | 14.0 | 8.0 | 11.0 | 12.0 | 10.0 | 14.0 | 8.0 | 11.0 | 12.0 | 10.0 |
| Ammonium nitrate | 62.8 | 56.5 | 71.4 | 71.1 | 73.4 | 62.8 | 56.5 | 71.4 | 71.1 | 73.4 |
| Sodium nitrate | 10.0 | 15.0 | 7.5 | 7.5 | 6.0 | 10.0 | 15.0 | 7.5 | 7.5 | 6.0 |
| Hydrazine nitrate | | 10.0 | | | | | 10.0 | | | |
| Sorbitan monooleate | | 2.0 | | 0.7 | | | 2.0 | | 0.7 | |
| Sorbitol dioleate | 4.5 | | 2.7 | 0.5 | 3.1 | 4.5 | | 2.7 | 0.5 | 3.1 |
| B28/750 | 6.2 | 2.0 | 4.2 | 5.2 | 4.5 | 6.2 | 2.0 | 4.2 | 5.2 | 4.5 |
| Perlite | | 3.0 | | | | | 3.0 | | | |
| Specific gravity | 1.10 | 1.21 | 1.18 | 1.14 | 1.16 | 1.11 | 1.20 | 1.18 | 1.14 | 1.15 |
| Just after Preparation | Detonated with No. 6 cap | Detonated with No. 6 cap | Detonated with No. 6 cap | Detonated with No. 6 cap | Detonated with No. 6 cap | Failed with No. 6 cap | Failed with No. 6 cap | Failed with No. 6 cap | Failed with No. 6 cap | Failed with No. 6 cap |
| After one months | Detonated with No. 6 cap | Detonated with No. 6 cap | Detonated with No. 6 cap | Detonated with No. 6 cap | Detonated with No. 6 cap | Failed with No. 6 cap Detonated with No. 8 cap | Failed with No. 6 cap | Failed with No. 6 cap | Failed with No. 6 cap | Failed with No. 6 cap |
| After 2 months | Detonated with No. 6 cap | Detonated with No. 6 cap | Detonated with No. 6 cap | Detonated with No. 6 cap | Detonated with No. 6 cap | Failed with No. 8 cap | Failed with No. 6 cap Detonated with No. 8 cap | Failed with No. 6 cap | Failed with No. 6 cap | Failed with No. 6 cap |
| After 3 months | Detonated with No. 6 cap | Detonated with No. 6 cap | Detonated with No. 6 cap | Detonated with No. 6 cap | Detonated with No. 6 cap | — | Failed with No. 8 cap | Failed with No. 6 cap | Failed with No. 6 cap Detonated with No. 8 cap | Failed with No. 6 cap |
| After 4 months | Failed with No. 6 cap Detonated with No. 8 cap | Detonated with No. 6 cap | Detonated with No. 6 cap | Detonated with No. 6 cap | Detonated with No. 6 cap | — | — | Failed with No. 6 cap Detonated with No. 8 cap | Failed with No. 8 cap | Failed with No. 6 cap Detonated with No. 8 cap |
| After 5 months | Failed with No. 8 cap | Failed with No. 6 cap Detonated with No. 8 cap | Detonated with No. 6 cap | Detonated with No. 6 cap | Detonated with No. 6 cap | — | — | Failed with No. 8 cap | — | Failed with No. 8 cap |
| After 6 months | — | Failed with No. 8 cap | Failed with No. 6 cap Detonated with No. 8 | Failed with No. 6 cap Detonated with No. 8 | Detonated with No. 6 cap | — | — | — | — | — |

TABLE 1-continued

| | Example | | | | | Comparative Example | | | | |
|---|---|---|---|---|---|---|---|---|---|---|
| | 1 | 2 | 3 | 4 | 5 | 1 | 2 | 3 | 4 | 5 |
| After 7 months | — | — | cap Failed with No. 8 cap | cap Failed with No. 8 cap | Failed with No. 6 cap Detonated with No. 8 cap | — | — | — | — | — |
| After 8 months | — | — | — | — | Failed with No. 8 cap | — | — | — | — | — |

From comparison of the Examples with the corresponding Comparative Examples (such as Example 1 and Comparative Example 1) by the results shown in Table 1, it is clearly seen that the explosives according to the Examples of this invention are noticeably prolonged in the storage period until the explosives loses its No. 8 cap sensitivity due to lowering of sensitivity in comparison with the explosives of the Comparative Examples.

It is evident that the W/O type emulsion explosives according to the Examples of this invention are very stable even at high temperatures.

What is claimed is:

1. A water-in-oil type emulsion explosive comprising an aqueous oxidizer solution, an oily material, an emulsifier and hollow microspheres, wherein the whole or a part of said oily material is replaced with a polymer which is oil-soluble and has a ladder structure in the molecule.

2. A water-in-oil type emulsion explosive according to claim 1, comprising 50 to 95% by weight of the aqueous oxidizer solution, 1 to 10% by weight of the oily material 0.5 to 7% by weight of the emulsifier and 0.5 to 20% by weight of the hollow microspheres of said water-in-oil type emulsion explosive.

3. A water-in-oil type emulsion explosive according to claim 1, wherein the polymer has a softening point of 0° to 150° C. and a number average molecular weight of 50 to 2,000.

4. A water-in-oil type emulsion explosive according to claim 1, wherein the polymer is a polymer or copolymer of dicyclopentadiene.

5. A water-in-oil type emulsion explosive according to claim 1, wherein the polymer is an aliphatic/alicyclic hydrocarbon resin.

6. A water-in-oil type emulsion explosive according to claim 1, wherein the polymer is an alicyclic hydrocarbon resin.

7. A water-in-oil type emulsion explosive according to claim 1, wherein the polymer is a hydrogenated alicyclic hydrocarbon resin.

8. A water-in-oil type emulsion explosive according to claim 1, wherein the polymer is contained in an amount of 5 to 70% by weight of the oily material.

* * * * *

UNITED STATES PATENT AND TRADEMARK OFFICE

CERTIFICATE OF CORRECTION

PATENT NO. : 5,000,802

DATED : March 19, 1991

INVENTOR(S) : Yoshiyuki Ikeda, Atsuo Inoue and Yoshio Tanabe

It is certified that error appears in the above-identified patent and that said Letters Patent is hereby corrected as shown below:

On Title page, after "[22] Filed: Aug. 9, 1990" insert

-- [30] Foreign Application Priority Data

Aug. 21, 1989 [JP] Japan ..... 01-212899 --

Signed and Sealed this

Sixth Day of October, 1992

*Attest:*

DOUGLAS B. COMER

*Attesting Officer*

*Acting Commissioner of Patents and Trademarks*